US009637348B2

(12) United States Patent
Okada

(10) Patent No.: US 9,637,348 B2
(45) Date of Patent: May 2, 2017

(54) ELEVATOR APPARATUS

(75) Inventor: Mineo Okada, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 262 days.

(21) Appl. No.: 14/380,753

(22) PCT Filed: Apr. 16, 2012

(86) PCT No.: PCT/JP2012/060244

§ 371 (c)(1),
(2), (4) Date: Aug. 25, 2014

(87) PCT Pub. No.: WO2013/157069

PCT Pub. Date: Oct. 24, 2013

(65) Prior Publication Data

US 2015/0041256 A1 Feb. 12, 2015

(51) Int. Cl.
*B66B 5/12* (2006.01)
*B66B 5/18* (2006.01)
(Continued)

(52) U.S. Cl.
CPC ..... *B66B 5/0031* (2013.01); *B66B 5/12* (2013.01); *B66B 5/16* (2013.01); *B66B 5/18* (2013.01); *B66B 5/044* (2013.01)

(58) Field of Classification Search
CPC B66B 5/044; B66B 5/046; B66B 5/12; B66B 5/125; B66B 5/16; B66B 5/18; B66B 9/0861
(Continued)

(56) References Cited

U.S. PATENT DOCUMENTS 394,952 A * 12/1888 Baxter, Jr. et al. ..... B66B 5/12 187/277
1,443,841 A * 1/1923 Gudmundson ..... B66B 5/18 187/351
(Continued)

FOREIGN PATENT DOCUMENTS

CH EP 1733992 A1 * 12/2006 ..... B66B 5/18
DE 102005045114 A1 * 4/2007 ..... B66B 5/18
(Continued)

OTHER PUBLICATIONS

International Search Report Issued Jul. 17, 2012 in PCT/JP12/060244 filed Apr. 16, 2012.

*Primary Examiner* — William A Rivera
*Assistant Examiner* — Stefan Kruer
(74) *Attorney, Agent, or Firm* — Oblon, McClelland, Maier & Neustadt, L.L.P.

(57) ABSTRACT

In an elevator apparatus, an abnormal acceleration detecting mechanism includes a mass body that operates in connection with movement of the car, the abnormal acceleration detecting mechanism operating a safety device using a force of inertia that is generated by the mass body if an acceleration that exceeds a predetermined set value arises in a car. A breakage detecting means detects breakage of a suspending means that suspends the car. A resistance force applying apparatus applies a resistance force to a mechanism for activating the safety device such that the resistance force is applied when breakage of the suspending means is not detected by the breakage detecting means and the resistance force is reduced if breakage of the suspending means is detected by the breakage detecting means.

6 Claims, 4 Drawing Sheets

(51) Int. Cl.
*B66B 5/04* (2006.01)
*B66B 5/00* (2006.01)
*B66B 5/16* (2006.01)
*B66B 11/08* (2006.01)

(58) Field of Classification Search
USPC ..... 187/372, 376
See application file for complete search history.

(56) References Cited

U.S. PATENT DOCUMENTS 1,937,035 A * 11/1933 Dunlop ..... B66B 5/18 187/350
2,581,297 A * 1/1952 Rissler ..... B66B 5/18 187/375
3,762,512 A * 10/1973 McIntyre ..... B66B 5/22 187/372
4,083,432 A 4/1978 Lusti
5,224,570 A * 7/1993 Fromberg ..... B66B 5/22 187/376
5,301,773 A * 4/1994 Jamieson ..... B66B 5/22 187/376
5,363,942 A * 11/1994 Osada ..... B66B 5/22 187/376
5,370,208 A * 12/1994 De Jong ..... B66B 5/22 187/372
5,628,385 A * 5/1997 Yumura ..... B66B 5/044 187/373
5,937,973 A * 8/1999 Liebetrau ..... B66B 5/22 187/373
5,950,768 A * 9/1999 Gensike ..... B66B 5/22 187/376
5,964,320 A * 10/1999 Kato ..... B66B 5/22 187/375
7,703,578 B2 * 4/2010 Kugiya ..... B66B 5/12 187/390
7,849,972 B2 * 12/2010 Higashinaka ..... B66B 5/18 187/286
2007/0170010 A1 7/2007 Higashinaka
2012/0305338 A1 * 12/2012 Kocher ..... B66B 5/18 187/359
2013/0220739 A1 8/2013 Okada et al.

FOREIGN PATENT DOCUMENTS

JP 53-071445 6/1978
JP 04292389 A * 10/1992
JP 2012-062124 3/2012
WO 2005/115904 12/2005
WO 2012/059970 5/2012

* cited by examiner

ELEVATOR APPARATUS

TECHNICAL FIELD

The present invention relates to an elevator apparatus in which a car is made to perform an emergency stop when there is an abnormality such as breakage of a suspending means or failure of a controlling apparatus, for example.

BACKGROUND ART

In conventional elevator apparatus speed governors, a first overspeed Vos (an activating velocity of an operation stopping switch) is set to approximately 1.3 times a rated velocity Vo, and a second overspeed Vtr (a safety activating velocity) is set to approximately 1.4 times the rated velocity Vo. If it is detected that the car has exceeded the rated velocity and reached the first overspeed Vos due to an abnormality in the controlling apparatus, for example, power supply to a hoisting machine is interrupted to stop the car urgently. If the car is falling due to breakage of a main rope, etc., the second overspeed Vtr is detected by the speed governor, and a safety device is activated to make the car perform an emergency stop.

However, if the car is positioned in a vicinity of a terminal floor of a hoistway, the car may reach a bottom portion of the hoistway before the car velocity increases to the first overspeed Vos and the second overspeed Vtr, and in that case the car is decelerated and stopped by a buffer. For this purpose, the buffer requires a longer buffering stroke as the velocity that must be decelerated increases, and the length of the buffer is determined by the first overspeed Vos and the second overspeed Vtr.

In answer to that, a method has also been proposed in which a car position switch is disposed in a vicinity of the terminal floor to detect an abnormality and shut off the power supply to the hoisting machine at a terminal overspeed Vts that is lower than the first overspeed Vos when the car position switch is operated.

Thus, provided that the main rope is still connected to the car, the car velocity will not exceed the terminal overspeed Vts. If, on the other hand, the main rope breaks when the car is positioned in a vicinity of a lower terminal floor of the hoistway, it is not possible to brake the car using the hoisting machine even if the terminal overspeed Vts is detected.

In that case, if Ts is the time from when the main rope breaks until the car collides with the buffer, then the impact velocity Vs is:

$$Vs=Vts+g\times Ts$$

If this impact velocity Vs is lower than the second overspeed Vtr of the speed governor, then it is possible to shorten the buffering stroke of the buffer proportionately.

However, in recent years, there is demand for additional space saving and cost saving, and there has been demand for buffer dimensions to be shortened further, and speed governors have been proposed in which the first overspeed Vos and the second overspeed Vtr are reduced in the vicinity of terminal floors (see Patent Literature 1 and 2, for example).

CITATION LIST

Patent Literature

[Patent Literature 1]
Japanese Patent Laid-Open No. 2003-104646 (Gazette)
[Patent Literature 2]
WO 2009/093330

SUMMARY OF THE INVENTION

Problem to be Solved by the Invention

In conventional elevator apparatuses such as those described above, the construction of the speed governors becomes complicated in order to lower the first overspeed Vos and the second overspeed Vtr in the vicinity of the terminal floors.

The present invention aims to solve the above problems and an object of the present invention is to provide an elevator apparatus that enables space saving in a hoistway by a simple configuration.

Means for Solving the Problem

In order to achieve the above object, according to one aspect of the present invention, there is provided an elevator apparatus including: a car; a suspending means that suspends the car; a driving apparatus that raises and lowers the car by means of the suspending means; a car guide rail that guides raising and lowering of the car; a safety device that is mounted onto the car, and that engages with the car guide rail to make the car perform an emergency stop; an abnormal acceleration detecting mechanism that includes a mass body that operates in connection with movement of the car, the abnormal acceleration detecting mechanism operating the safety device using a force of inertia that is generated by the mass body if an acceleration that exceeds a predetermined set value arises in the car; a breakage detecting means that detects breakage of the suspending means; and a resistance force applying apparatus that applies a resistance force to a mechanism for activating the safety device such that the resistance force is applied when breakage of the suspending means is not detected by the breakage detecting means and the resistance force is reduced if breakage of the suspending means is detected by the breakage detecting means.

Effects of the Invention

In an elevator apparatus according to the present invention, because the braking apparatus is operated by the abnormal acceleration detecting mechanism if acceleration that exceeds a preset set value arises in the car, space saving can be achieved in a hoistway by a simple configuration without complicating construction of a speed governor. Because the resistance force applying apparatus applies a resistance force to the mechanism for activating the safety device when breakage of the suspending means is not detected by the breakage detecting means and reduces the resistance force if breakage of the suspending means is detected, the settable range of the force that is required in order to activate the safety device can be widened, enabling adjustment of the force that is required in order to activate the safety device to be performed more simply, and also enabling increases in cost for the adjustment of the inertial mass of the mass body to be suppressed.

DESCRIPTION OF EMBODIMENTS

A preferred embodiment of the present invention will now be explained with reference to the drawings.

Embodiment 1

Figure 1:
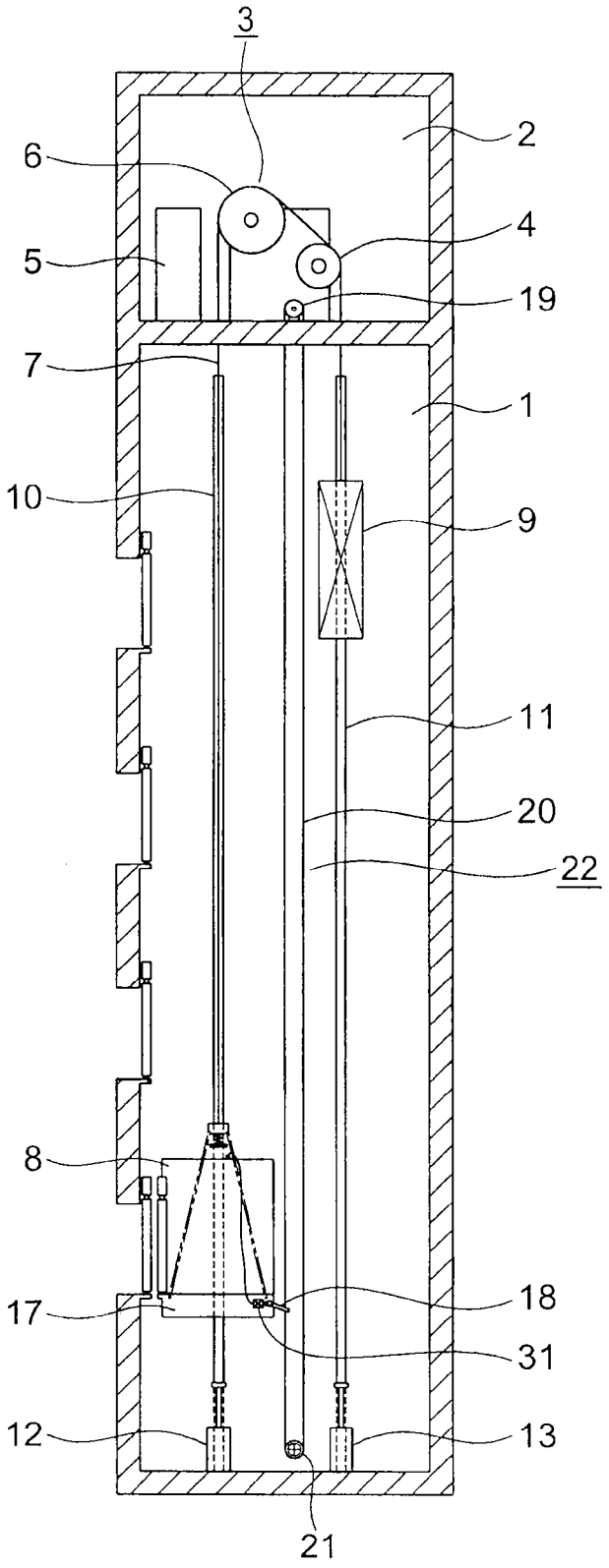
FIG. 1 is a configuration diagram that shows an elevator apparatus according to Embodiment 1 of the present invention.

FIG. 1 is a configuration diagram that shows an elevator apparatus according to Embodiment 1 of the present invention. In the figure, a machine room 2 is disposed in an upper portion of a hoistway 1. Installed in the machine room 2 are: a hoisting machine (a driving apparatus) 3; a deflecting sheave 4; and a controlling apparatus 5. The hoisting machine 3 has: a driving sheave 6; a hoisting machine motor that rotates the driving sheave 6; and a hoisting machine brake (an electromagnetic brake) that brakes rotation of the driving sheave 6.

The hoisting machine brake has: a brake wheel (a drum or a disk) that is coupled coaxially to the driving sheave 6; a brake shoe that is placed in contact with and separated from the brake wheel; a brake spring that presses the brake shoe against the brake wheel to apply a braking force; and an electromagnet that separates the brake shoe from the brake wheel in opposition to the brake spring to release the braking force.

A suspending means 7 is wound around the driving sheave 6 and the deflecting sheave 4. A plurality of ropes or a plurality of belts are used as the suspending means 7. A car 8 is connected to a first end portion of the suspending means 7. A counterweight 9 is connected to a second end portion of the suspending means 7.

The car 8 and the counterweight 9 are suspended inside the hoistway 1 by the suspending means 7, and are raised and lowered inside the hoistway 1 by the hoisting machine 3. The controlling apparatus 5 raises and lowers the car 8 at a set velocity by controlling rotation of the hoisting machine 3.

A pair of car guide rails 10 that guide raising and lowering of the car 8 and a pair of counterweight guide rails 11 that guide raising and lowering of the counterweight 9 are installed inside the hoistway 1. A car buffer 12 that buffers collision of the car 8 into a hoistway bottom portion, and a counterweight buffer 13 that buffers collision of the counterweight 9 into the hoistway bottom portion are installed on the bottom portion of the hoistway 1.

A safety device 17 that functions as a braking apparatus that makes the car 8 perform an emergency stop by engaging with a car guide rail 10 is mounted onto a lower portion of the car 8. A gradual safety is used as the safety device 17 (gradual safeties are generally used in elevator apparatuses in which rated velocity exceeds 45 m/min). An activating lever 18 that activates the safety device 17 is disposed on the safety device 17.

A speed governor 19 that detects an overspeed (an abnormal velocity) of the car 8 is installed in the machine room 2. The speed governor 19 has a speed governor sheave, an overspeed detecting switch, a rope catch, etc. An endless speed governor rope 20 is wound around the speed governor sheave. The speed governor rope 20 is set up in a loop inside the hoistway 1. The speed governor rope 20 is wound around a tensioning sheave 21 that is disposed in a lower portion of the hoistway 1.

The speed governor rope 20 is connected to the activating lever 18. Thus, the speed governor rope 20 is cycled when the car 8 is raised and lowered to rotate the speed governor sheave at a rotational velocity that corresponds to the traveling velocity of the car 8. A mass body 22 according to Embodiment 1 is constituted by the speed governor 19, the speed governor rope 20, and the tensioning sheave 21.

The traveling velocity of the car 8 reaching the overspeed is detected mechanically by the speed governor 19. A first overspeed Vos that is higher than a rated velocity Vo and a second overspeed Vtr that is higher than the first overspeed are set as detected overspeeds.

The overspeed detecting switch is operated if the traveling velocity of the car 3 reaches the first overspeed Vos. When the overspeed detecting switch is operated, power supply to the hoisting machine 3 is interrupted to stop the car 8 urgently using the hoisting machine brake.

If the descent velocity of the car 8 reaches the second overspeed Vtr, the speed governor rope 20 is gripped by the rope catch to stop the cycling of the speed governor rope 20. When the cycling of the speed governor rope 20 is stopped, the activating lever 18 is operated, and the car 8 is made to perform an emergency stop by the safety device 17.

Figure 2:
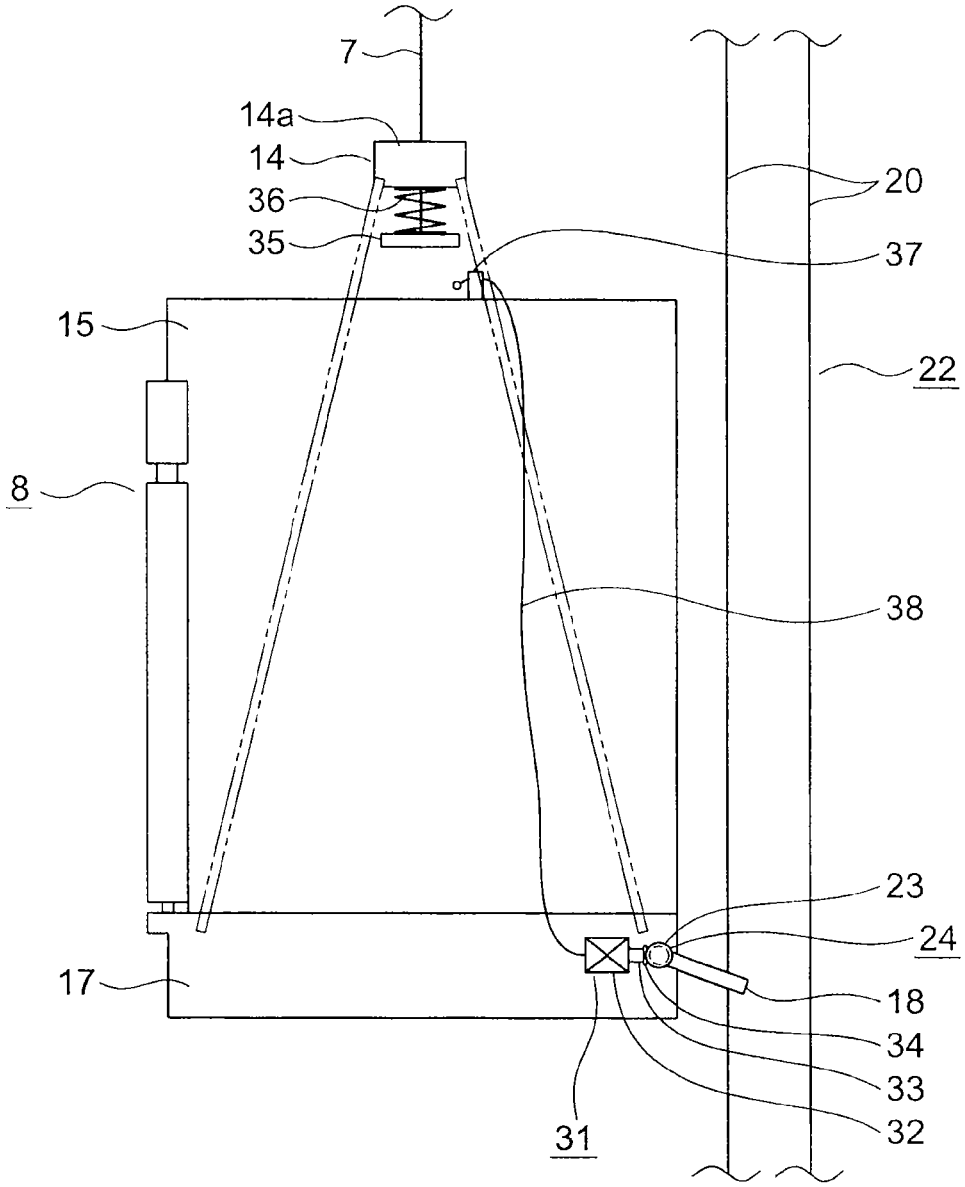
FIG. 2 is a configuration diagram that shows a car from FIG. 1 enlarged.

FIG. 2 is a configuration diagram that shows the car 8 from FIG. 1 enlarged. A torsion spring 23 that applies torque to the activating lever 18 in a direction (counterclockwise in the figure) that is opposite to the direction that activates the safety device 17 is disposed on the pivoting shaft of the activating lever 18. The spring force of the torsion spring 23 is set such that the safety device 17 is not activated in a normal hoisting state. An abnormal acceleration detecting mechanism 24 according to Embodiment 1 includes the mass body 22 and the torsion spring 23.

An electromagnetic actuator 31 that functions as a resistance force applying apparatus that applies a resistance force to a mechanism for activating the safety device 17 is disposed on the safety device 17. The electromagnetic actuator 31 has: a solenoid coil 32; an activating segment 33; and a shoe 34 that is fixed to an end of the activating segment 33.

The activating segment 33 is projected outward by excitation of the solenoid coil 32, pressing the shoe 34 against the activating lever 18. Rotational resistance is thereby applied to the activating lever 18. The activating segment 33 is retracted toward the solenoid coil 32 by the passage of electric current to the solenoid coil 32 being interrupted, separating the shoe 34 from the activating lever 18. Rotational resistance that is applied to the activating lever 18 is reduced thereby (in this case, removed).

The car 8 has: a car frame 14; and a cage 15 that is supported by the car frame 14. The car frame 14 has an upper beam **14*a* that is disposed horizontally above the cage 15. A first end portion of the suspending means 7 is connected to the upper beam 14*a***.

A terminal member 35 is mounted onto the first end portion of the suspending means 7. A pushing spring 36 is disposed between the terminal member 35 and a lower surface of the upper beam **14*a*. The pushing spring 36 is pressed by a force that is proportionate to the weight of the car 8, and applies tension to the suspending means 7**.

A breakage detecting switch 37 that functions as a breakage detecting means that detects breakage of the suspending means 7 is disposed on an upper portion of the cage 15. If there are two or more terminal members 35, two or more breakage detecting switches 37 are disposed so as to correspond to each terminal member 35.

Figure 3:
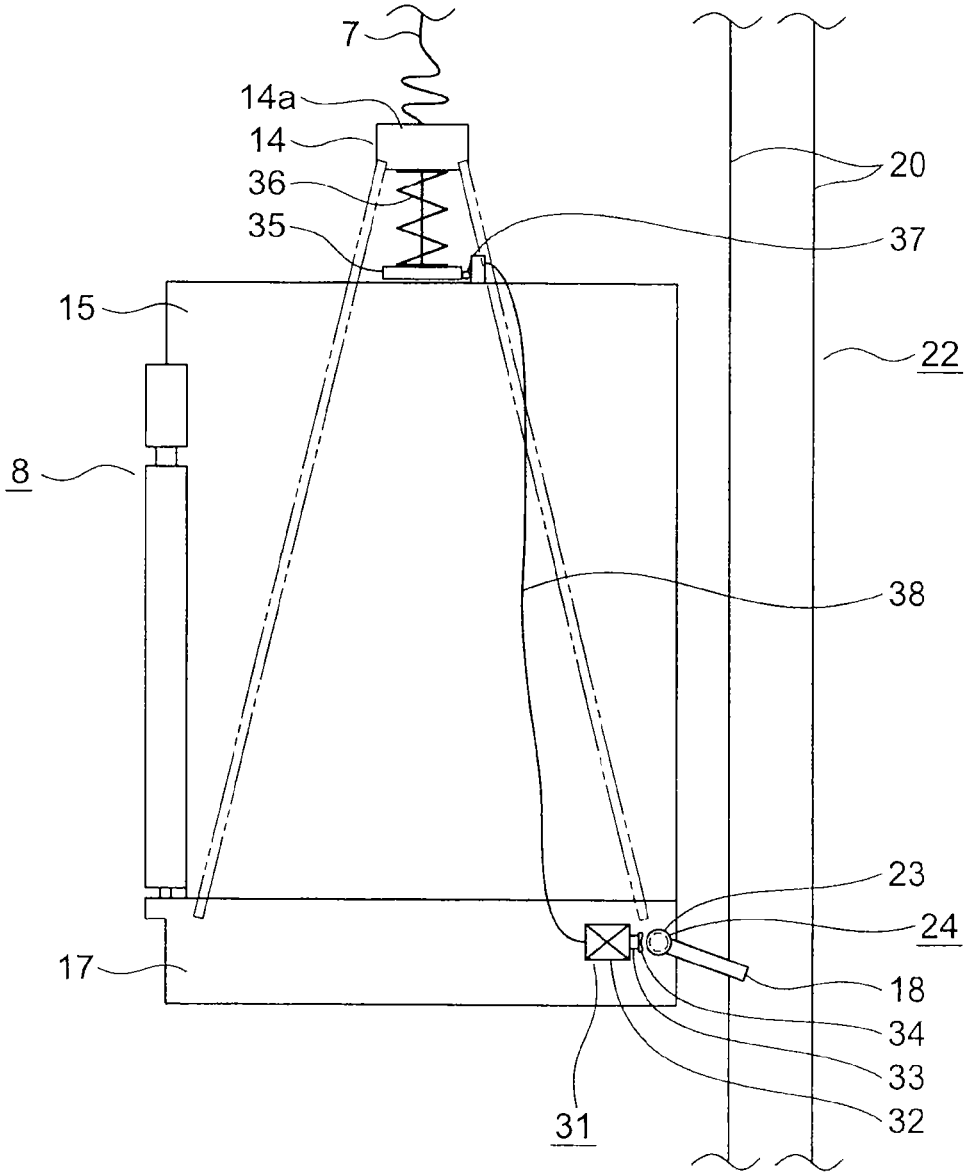
FIG. 3 is a configuration diagram that shows a state in which a suspending means from FIG. 2 is broken.

The breakage detecting switch 37 is connected to the solenoid coil 32 by means of wiring 38. As shown in FIG. 3, in the rare event that the suspending means 7 breaks for some reason, the pushing spring 36 expands as tension is lost in the suspending means 7. The breakage detecting switch 37 is thereby actuated as the terminal member 35 moves downward relative to the car 8.

When the breakage detecting switch 37 is actuated by the terminal member 35, the passage of electric current to the solenoid coil 32 is interrupted. If the breakage detecting switch 37 is not actuated, the solenoid coil 32 is energized.

Now, in the elevator apparatus according to Embodiment 1, the force Fs (N) that is required to activate the safety device 17 changes depending on the presence or absence of rotational resistance that is applied to the activating lever 18 by the electromagnetic actuator 31. Specifically, if Fs1 (N) is the force that is required to activate the safety device 17 when the suspending means 7 is not broken, and Fs2 (N) is the force that is required to activate the safety device 17 when the suspending means 7 is broken, then:

$$Fs2<Fs1$$

Figure 4:
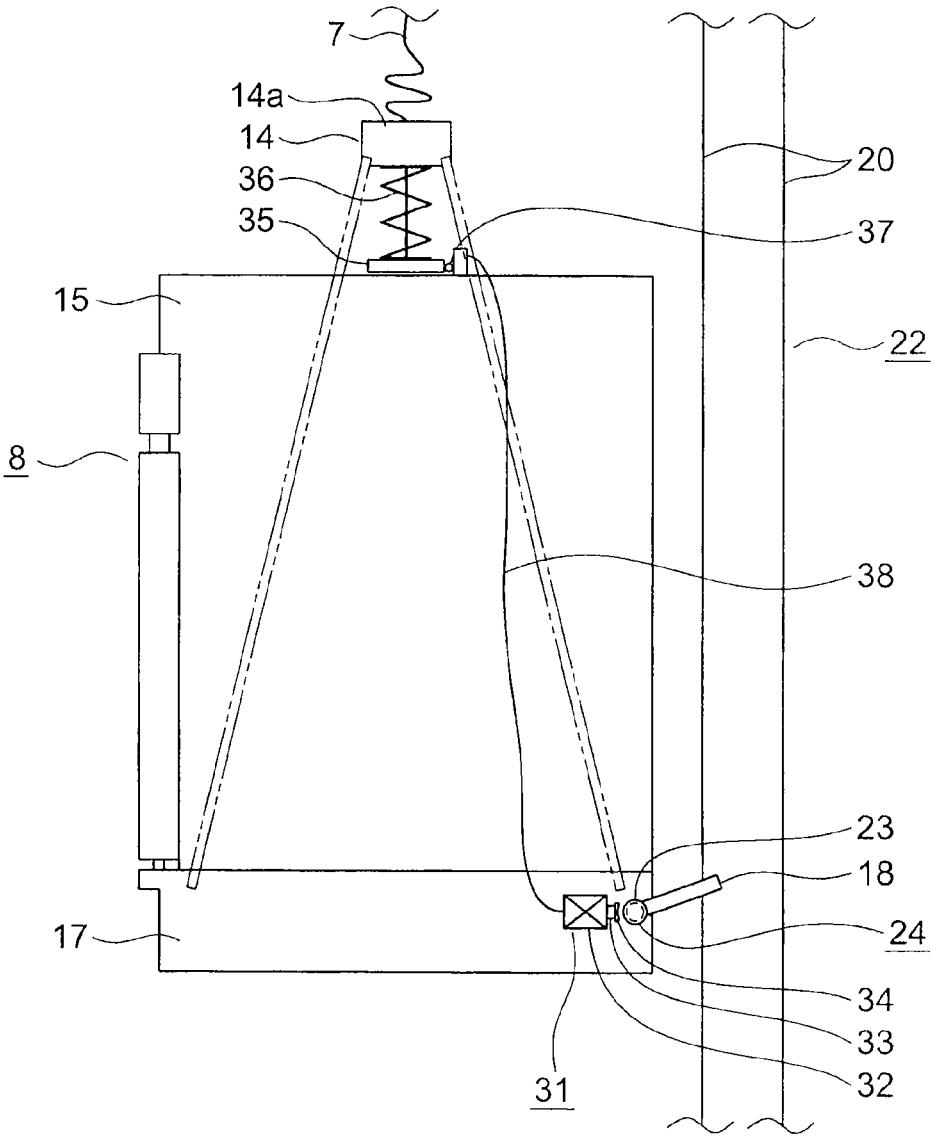
FIG. 4 is a configuration diagram that shows a state in which an activating lever from FIG. 3 is actuated.

When rotational resistance is not being applied to the activating lever 18, the activating lever 18 is pivoted counterclockwise (lifted) as shown in FIG. 4 in opposition to the torque of the torsion spring 23 and the weight of the activating lever 18 and other parts (not shown) of the safety device 17 when a force that exceeds Fs2 (N) in magnitude is applied upward at the position at which the speed governor rope 20 is attached, and is adjusted such that the safety device 17 is activated thereby.

If the mass of the speed governor rope 20 is Mr (kg), the inertial mass of the speed governor 19 at the diameter around which the speed governor rope 20 is wound is Mg (kg), and the inertial mass of the tensioning sheave 21 at the diameter around which the speed governor rope 20 is wound is Mh (kg), then the inertial mass Mt (kg) of the mass body 22 at the position of the activating lever 18 is:

$$Mt=Mr+Mg+Mh$$

Now, if the suspending means 7 breaks and the car 8 accelerates at gravitational acceleration g (m/s$^2$), then the car 8 is subjected to an inertial force Fp (N) from the mass body 22 upward at the activating lever 18 that has a magnitude that is found by the following expression:

$$Fp=Mt\times g \quad (1)$$

The safety device 17 is activated when this inertial force Fp (N) exceeds the force Fs2 (N) that is required to activate the safety device 17:

$$Fs2<Mt\times g \quad (2)$$

Consequently, by adjusting the force Fs2 (N) that is required to activate the safety device 17 and the inertial mass Mt (kg) of the mass body 22, it becomes possible to activate the safety device 17 if the suspending means 7 breaks and the car 8 falls, even if the speed governor 19 does not detect the second overspeed Vtr.

When the abnormal acceleration that is detected by this abnormal acceleration detecting mechanism is substituted, the abnormality detection velocity Vi follows a pattern that is separated by a predetermined distance from, and approximately parallel to, the velocity pattern of the car 8 when it travels normally from an upper portion terminal floor to a lower portion terminal floor.

If the suspending means 7 breaks when the velocity of the car 8 is zero, then the safety device 17 is activated by the inertial force of the mass body 22 when the velocity of the car 8 reaches Vio. The force Fs2 that is required to activate the safety device 17 and the inertial mass Mt of the mass body 22 are adjusted such that this Vio is less than the "g×Ts" that was explained in the background art.

Because the velocity at which emergency braking is performed on the car 8 due to detection of abnormal acceleration can thereby be reduced compared to the abnormal velocity that is detected by the speed governor 19, the buffering stroke of the car buffer 12 can be shortened, enabling costs of the car buffer 12 to be reduced. The dimensions in the bottom portion of the hoistway 1 for installing the car buffer 12 can also be shortened. In other words, space saving can be achieved in the hoistway 1 by a simple configuration without complicating the construction of the speed governor 19.

It is possible to set Vio to any magnitude by further adjusting the force Fs2 (N) that is required to activate the safety device 17 and the inertial mass Mt (kg) of the mass body 22.

On the other hand, the car 8 is also stopped urgently if the controlling apparatus 5 stops the supply of electric power to the hoisting machine 3 due to abnormality detection or power outage of some type while the car 8 is traveling downward. If the deceleration rate of the car 8 at that time is $\alpha$ (m/s$^2$), then the car 8 is subjected to upward inertial force Fe (N) from the mass body 22 at the activating lever 18 according to the following expression:

$$Fe=Mt\times\alpha \quad (3)$$

Because the safety device 17 is activated if this inertial force Fe (N) is greater than the force Fs (N) that is required to activate the safety device 17, it is necessary to satisfy the following expression in order to prevent this kind of malfunction:

$$Fs>Mt\times\alpha \quad (4)$$

Consequently, it is necessary for the force Fs that is required to activate the safety device 17 to satisfy Expressions (2) and (4) simultaneously:

$$Mt\times\alpha<Fs<Mt\times g \quad (5)$$

However, if the inertial mass Mt (kg) of the mass body 22 is small, such as when the height dimensions of the hoistway 1 are short, for example, the settable range of the force Fs (N) that is required to activate the safety device 17 becomes narrow, making it troublesome to adjust the force Fs (N) at the factory, thereby increasing costs.

The inertial mass Mt (kg) of the mass body 22 should be increased in order to widen the settable range of the force Fs (N) that is required to activate the safety device 17. However, in that case, the force Fs (N) that is required to activate the safety device 17 is also increased, and it is also subsequently necessary to increase the gripping force Fg (N) that is imparted to the suspending means 7 when the speed governor 19 detects the second overspeed Vtr (normally around approximately 1.4 times the rated velocity Vo). Because of that, it is necessary to increase the size of the speed governor 19, and costs increase together with the increase in the weight of the inertial mass Mt (kg) of the mass body 22.

In contrast to that, in Embodiment 1, if the suspending means 7 is not broken, then rotational resistance is imparted to the activating lever 18 by the electromagnetic actuator 31, setting the force Fs1 that is required to activate the safety device 17 to greater than Fs2.

If Fsx (N) is the magnitude of rotational resistance from the electromagnetic actuator 31, then the relationship between Fs1 and Fs2 is given by the following expression:

$$Fs1=Fs2+Fsx \quad (6)$$

At the factory, the force Fs2 (N) that is required to activate the safety device 17 when there is no electromagnetic actuator 31 is adjusted. The electromagnetic actuator 31 is next mounted onto the safety device 17, and the shoe 34 is pressed against the rotating base portion of the activating lever 18.

If the car 8 is stopped urgently due to abnormality detection or power outage of some type while the car 8 is traveling downward when the suspending means 7 is not broken, then the safety device 17 does not activate if the force of inertia Fe that is shown in Expression (3) (=Mt×α) (N) is less than the force Fs1 (N) that is required to activate the safety device 17:

$$Fs1(=Fs2+Fsx)>Mt\times\alpha \quad (7)$$

Because of that, the force Fs2 is set so as to satisfy Expressions (2) and (7) simultaneously:

$$Mt\times\alpha-Fsx<Fs2<Mt\times g \quad (8)$$

Under the conditions of Expression (8), the settable range of Fs2 (N) is enlarged by an amount proportionate to the magnitude of rotational resistance Fsx (N) of the electromagnetic actuator 31 compared to the conditions of Expression (5). In other words, the magnitude of the force of inertia that is required to activate the safety device 17 can be reduced if the suspending means 7 is broken. Because of that, adjustment of the force Fs2 (N) that is required to activate the safety device 17 can be performed more simply at the factory.

Increasing the inertial mass Mt (kg) of the mass body 22 is no longer necessary, and increasing the size of the speed governor 19 is also no longer necessary, enabling increases in cost to be suppressed.

In addition, in Embodiment 1, the car 8 can be stopped when the first overspeed is detected by the speed governor 19, and the safety device 17 can be activated conventionally using the speed governor 19 and speed governor rope 20 as the mass body 22 during falling of the car 8. Because of that, a separate mass body is not required, enabling system configuration to be simplified.

Moreover, examples of methods for adjusting the inertial mass Mt of the mass body 22 include changing the thickness of the tensioning sheave 21, or adding a flywheel that rotates coaxially with the tensioning sheave 21, for example.

In Embodiment 1, a torsion spring 23 is used in order to adjust the force Fs that is required to activate the safety device 17, but a spring, etc., does not necessarily have to be added, provided that an adequate force Fs can be achieved and, if added, is not limited to a torsion spring.

In addition, the breakage detecting means is not limited to the breakage detecting switch 37, nor is the position of installation thereof limited to the upper portion of the cage 15.

Furthermore, configurations of the mass body and the resistance force applying apparatus are not limited to those in Embodiment 1.

Furthermore, the type of elevator apparatus to which the present invention is applied is not limited to the type in FIG. 1. For example, in FIG. 1, a one-to-one (1:1) roping elevator apparatus is shown, but the roping method is not limited thereto, and the present invention can also be applied to two-to-one (2:1) roping elevator apparatuses, for example. The present invention can also be applied to machine-roomless elevators, multi-car elevators, or double-deck elevators, for example.

The invention claimed is:

1. An elevator apparatus comprising:

a car;

a suspending means that suspends the car;

a driving apparatus that raises and lowers the car by means of the suspending means;

a car guide rail that guides raising and lowering of the car;

a safety device that is mounted onto the car, and that engages with the car guide rail to make the car perform an emergency stop;

an abnormal acceleration detecting mechanism that includes a mass body that operates in connection with movement of the car, the abnormal acceleration detecting mechanism operating the safety device using a force of inertia that is generated by the mass body if an acceleration that exceeds a predetermined set value arises in the car;

a breakage detecting means that detects breakage of the suspending means; and a resistance force applying apparatus that applies a resistance force to a mechanism for activating the safety device such that the resistance force is applied so that the mechanism for activating the safety device activates the safety device upon a first abnormal acceleration that exceeds the predetermined set value being detected by the abnormal acceleration detecting mechanism when breakage of the suspending means is not detected by the breakage detecting means, and the resistance force is reduced so that the mechanism for activating the safety device activates the safety device upon a second abnormal acceleration that exceeds the predetermined set value being detected by the abnormal acceleration detecting mechanism if breakage of the suspending means is detected by the breakage detecting means, wherein the first abnormal acceleration is higher than the second abnormal acceleration.

2. The elevator apparatus according to claim 1, wherein the mass body includes:

a rope that is arranged in a loop inside a hoistway; and a sheave around which the rope is wound.

3. The elevator apparatus according to claim 2, further comprising a speed governor that detects an overspeed of the car, the sheave around which the rope is wound being a speed governor sheave that is disposed on the speed governor, and the rope being a speed governor rope.

4. The elevator apparatus according to claim 1, wherein:

the breakage detecting means is a breakage detecting switch that is operated by breakage of the suspending means;

the resistance force applying apparatus is an electromagnetic actuator; and passage of electric current to the electromagnetic actuator is interrupted to remove the resistance force due to the electromagnetic actuator when the breakage detecting switch is actuated.

5. The elevator apparatus according to claim 1, wherein:

an activating lever that is pivoted to activate the safety device is disposed on the safety device; and the resistance force applying apparatus applies rotational resistance to the activating lever.

6. An elevator apparatus comprising:

a car;

a suspending means that suspends the car;

a driving apparatus that raises and lowers the car by means of the suspending means;

a car guide rail that guides raising and lowering of the car;

an abnormal acceleration detecting mechanism that detects whether an acceleration of the car exceeds a predetermined set value;

a safety device mounted to the car, wherein an operation of the safety device is responsive to an acceleration of the car, to engage with the car guide rail to make the car perform an emergency stop;

a breakage detecting means that detects breakage of the suspending means; and a resistance applying apparatus that is actuatable to resist operation of the safety device such that a value of an acceleration of the car initiating the operation of the safety device is increased when the resistance force applying apparatus is actuated, wherein the actuation of the resistance force applying apparatus is responsive to the breakage detecting means such that the resistance force applying apparatus is actuated when breakage of the suspending means is not detected by the breakage detecting means and the resistance force applying apparatus is not actuated when breakage of the suspending means is detected by the breakage detecting means.

* * * * *